US006718700B2

(12) United States Patent
Rochman

(10) Patent No.: US 6,718,700 B2
(45) Date of Patent: Apr. 13, 2004

(54) SKID PLATE AND PRE-HUNG DOOR ASSEMBLY

(75) Inventor: Oded E. Rochman, Ontario (CA)

(73) Assignee: Rochman Universal Doors, Inc., Scarborough (CA)

( * ) Notice: Subject to any disclaimer, the term of this patent is extended or adjusted under 35 U.S.C. 154(b) by 0 days.

(21) Appl. No.: 10/011,740

(22) Filed: Dec. 11, 2001

(65) Prior Publication Data

US 2002/0073636 A1 Jun. 20, 2002

Related U.S. Application Data

(60) Provisional application No. 60/255,380, filed on Dec. 15, 2000.

(51) Int. Cl.[7] ..... E06B 1/70

(52) U.S. Cl. ..... 52/97; 52/213; 52/204.1; 52/210; 49/467; 49/476.1; 49/380; 206/325

(58) Field of Search ..... 52/97, 209, 210, 52/213, 204.1, 204.53, 302.6, 127.5, 127.6; 49/467, 471, 493.1, 380, 476.1; 206/594, 325, 321

(56) References Cited

U.S. PATENT DOCUMENTS

| | | | | | |
|---|---|---|---|---|---|
| 448,501 | A | * | 3/1891 | Bussert | 49/471 |
| 2,648,107 | A | * | 8/1953 | Bates, Jr. | 52/97 |
| 4,341,048 | A | * | 7/1982 | Minter | 52/211 |
| 4,555,882 | A | * | 12/1985 | Moffitt et al. | 52/209 |
| 4,884,687 | A | * | 12/1989 | Steves | 206/321 |
| 5,542,217 | A | * | 8/1996 | Larivee, Jr. | 49/471 |
| 5,881,521 | A | * | 3/1999 | Porter et al. | 52/417 |
| 6,098,343 | A | * | 8/2000 | Brown et al. | 52/11 |
| 6,161,343 | A | | 12/2000 | Young | 52/97 |
| 6,219,979 | B1 | * | 4/2001 | Lohr | 52/211 |
| 6,305,132 | B1 | * | 10/2001 | Smith | 52/204.1 |
| 6,371,188 | B1 | * | 4/2002 | Baczuk et al. | 52/204.1 |

FOREIGN PATENT DOCUMENTS

| | | | |
|---|---|---|---|
| EP | 550089 | * | 7/1993 |

* cited by examiner

*Primary Examiner*—Winnie Yip
(74) *Attorney, Agent, or Firm*—Liniak, Berenato & White, LLC

(57) ABSTRACT

The invention is directed to a skid plate and a method for attaching the skid plate to the bottom surface of a pre-hung door assembly to improve wear and moisture resistance. The skid plate includes a first side having a first shaped portion configured to conform to the bottom end of a first doorjamb arrangement and a second side having a second shaped portion configured to conform to the bottom end of a second doorjamb arrangement. The method for attaching the skid plate to the pre-hung door bottom surface includes applying an adhesive to bond the skid plate to the bottom surface, positioning the skid plate so that the first shaped portion and the second shaped portion align with their respective doorjamb ends, engaging tabs against the frame side surface to the doorjambs, and driving fasteners through the skid plate and tabs.

9 Claims, 7 Drawing Sheets

Fig. 1
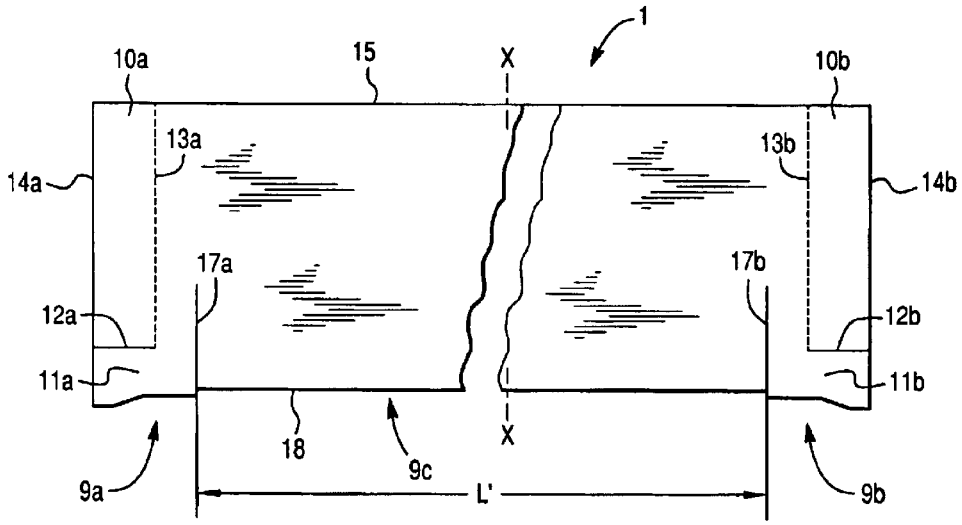
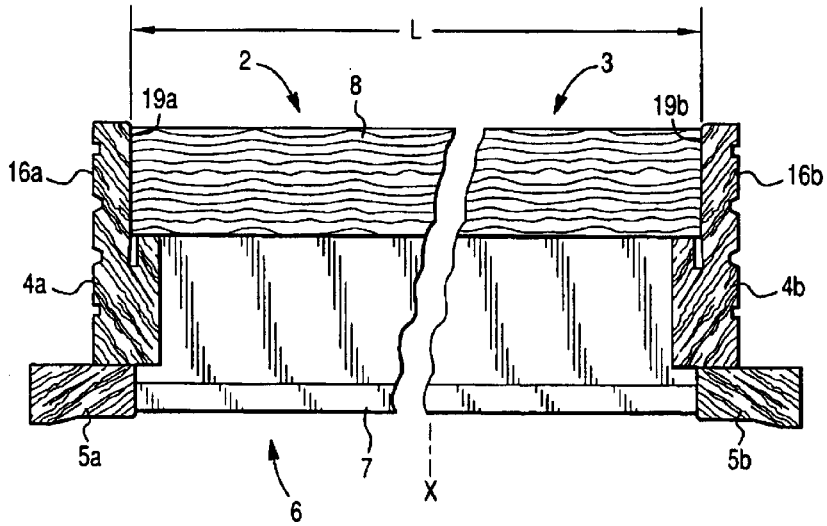
Fig. 2

SKID PLATE AND PRE-HUNG DOOR ASSEMBLY

This application claims the benefit of provisional patent application No. 60/255,380 filed Dec. 15, 2000.

FIELD OF THE INVENTION

This invention is directed to door assemblies, and in particular, it is directed to a skid plate for attachment to the bottom of a pre-hung door assembly whereby the attached skid plate provides a moisture barrier and prevents door bottom wear and/or damage during storage, handling and shipping of the manufactured door product.

BACKGROUND OF THE INVENTION

Pre-hung door assemblies typically include a pair of doorjambs that extend between a header and a threshold often called a sill plate, a door secured in its closed position during shipping and handling, and exterior trim or molding such as brickmold or the like that is attached to each of the doorjambs, the trim being adapted to receive and finish-off masonry or siding material applied to the exterior of a building being constructed. The wooden members located in the bottom portion of door assemblies are often exposed to wet conditions, for example rain water, and rotting occurs along the lower portion of such doors. In particular, such wood rot conditions begin at the crosscut bottom ends of the doorjambs and exterior trim. This is because such exposed end grain has a tendency to absorb and wick moisture or water up into the long grain portions of the wood members, and over time, the resulting damp, wood rotting condition, will migrate into other adjacent wooden members along the door bottom such as wooden sill plates. Usual construction practice involves placing door assembly bottoms on concrete supports such as foundation walls or slabs. A protective coating such as paint or the like is then applied to the exterior surfaces of the jambs, header, trim, and door. However, such exterior protective coatings fail to solve the wood rot problems associated with the jamb and trim end grain supported on concrete surfaces. Concrete is a relatively porous material, and moisture, rain water, and standing water will actually travel through concrete and into the end grain where the moisture is wicked up into the long grain of the respective wooden members. This invention relates broadly to providing a moisture resistant skid plate attached to the bottom or threshold of a pre-hung door assembly to provide both a moisture barrier that prevents such wood rot.

After a pre-hung door assembly is manufactured, it is shipped from the mill to a dealer and then forwarded to a construction site where the door assembly is framed into a building under construction. Careless handling during the journey from the mill to the construction site often causes damage to the exposed end grain portions at the door bottom, such damage ranging from minor damage such as gouging, to major damage such as splitting that requires repair and/or replacement of the damaged jamb and trim. This invention also relates to providing a method for fixing a skid plate to a door assembly bottom to improve door bottom protection against wear and damage during storage, shipping, and handling from the manufacturing phase through final construction phase where the door is installed in a framing operation.

There have been various attempts in the past to overcome problems associated with shipping and installing pre-hung door assemblies. However, many of these earlier solutions fail to recognize the need to protect door bottoms from wood rot, and therefore, they only address the problem of mechanical damage. For example, in the past, wafer board skid plates were used to protect pre-hung door assembly bottoms from damage during shipping to the construction site. Wafer board skid plates are problematic in that they needed to be removed before the door assembly can be framed into a building. An even bigger problem associated with wafer board is that the material readily absorbs water and often disintegrates before the door assembly reaches the construction site. Additionally, wet wafer board will accelerate wood rot along the door assembly bottom if the wet material is left in place during storage.

U.S. Pat. No. 6,161,343 to Young recognizes wood rotting problems associated with exposed grain ends along door assembly bottoms. Young attempts to solve the wood rot problem by applying a sealant to the end grain portions and then covering the sealant with a plastic plate. The patent teaches applying various wood sealants to the end grain, the exemplary sealants including a conventional water seal of the type used on outside wood decks, a thick grease comprising a mixture of paraffin and petroleum jelly, and a preferred sealant of olefin wax such as paraffin. After the sealant is applied to the exposed doorjamb end grain a plastic plate is attached to the respective doorjamb end by nails driven into the end grain whereby the sealant is captured between the plastic plate and the crosscut end of the jamb. The teaching of the Young patent makes it necessary to individually seal and nail a plastic plate to each doorjamb end, and in instances where the door assembly includes exterior trim (brickmold), to individually seal and nail a plastic plate to each exterior trim end. A disadvantage of the Young teaching is that it requires a labor-intensive manufacturing process where each end cut member must be individually handled during a multi-step sealing and nailing process in order to protect all the crosscut door members from wood rot. Another disadvantage of the Young teaching is that end nailing the plastic plates to the doorjamb and trim pieces results in a weak connection that is easily separated during shipping and handling.

SUMMARY OF THE INVENTION

It is therefore an object of the present invention to provide a skid plate along a door assembly bottom to prevent structural damage to the door assembly parts during shipping and handling.

It is a further object of the present invention to furnish a skid plate along a door assembly bottom that provides a moisture barrier to prevent wood rot in the door assembly parts.

It is another object of the present invention to furnish a skid plate along a door assembly bottom that provides a moisture barrier for the doorjamb and exterior trim bottom ends to prevent wood rot.

It is an additional object of the present invention to provide an improved method for fixing a skid plate to a door assembly bottom.

In satisfaction of the foregoing objects and advantages, the present invention provides a skid plate and a method for attaching the skid plate to the bottom surface of a pre-hung door assembly to improve wear and moisture resistance. In one embodiment, the skid plate is formed from a generally rectangular sheet of material having a top edge; a bottom edge; first and second side edges extending between the top edge and the bottom edge; a first tab defined by a first portion of the top edge, a first portion of the first side edge, a first fold line extending from the top edge parallel to the first side edge and a first cut extending from the first side edge to the first fold line, the first cut being spaced apart from the bottom edge by a first distance; a second tab defined by a second portion of the top edge, a first portion of the second side edge, a second fold line extending from the top edge parallel to the second side edge and a second cut extending from the second side edge to the second fold line; a first slit extending from the bottom edge parallel to the first side edge and having a length greater than the first distance; and a second slit extending from the bottom edge parallel to the second side edge and having a length greater than the first distance.

A pre-hung door assembly according to a preferred embodiment of the invention includes a sill plate, first and second door jambs connected to the sill plate, first and second trim members having ends and being connected to the first and second door jambs, and a skid plate. The skid plate includes a first planar portion overlying the sill plate, first and second regions on the planar portion shaped to cover the ends of the first and second trim members, and a first tab normal to the first planar portion. With this configuration, the first and second regions are aligned with the ends of the first and second trim members when the planar portion overlies the sill plate and the tab overlies the first side. Alternately, the door assembly according to one embodiment of the invention can be described as including a first side, a second side, a bottom including a first section having a first shape and a second section projecting from the first section and having a second shape, a skid plate having a first portion shaped like and overlying the first section and a second portion shaped like and overlying the second section and at least one tab extending from the second portion and overlying a portion of the first side.

BRIEF DESCRIPTION OF THE DRAWINGS

The above and other objects, advantages, and novel features of the present invention will become apparent from the following detailed description of the invention illustrated in the accompanying drawings, wherein:

FIG. 1 is a plan view of a skid plate blank

FIG. 2 is a plan view along the bottom of a door assembly.

DETAILED DESCRIPTION OF THE INVENTION

The following detailed description of the present invention is directed to a skid plate and a method for attaching the skid plate to the bottom surface of a pre-hung door assembly to prevent structural damage during shipping and handling, and to provide a moisture barrier against wood rot along the door assembly bottom.

Figure 9:
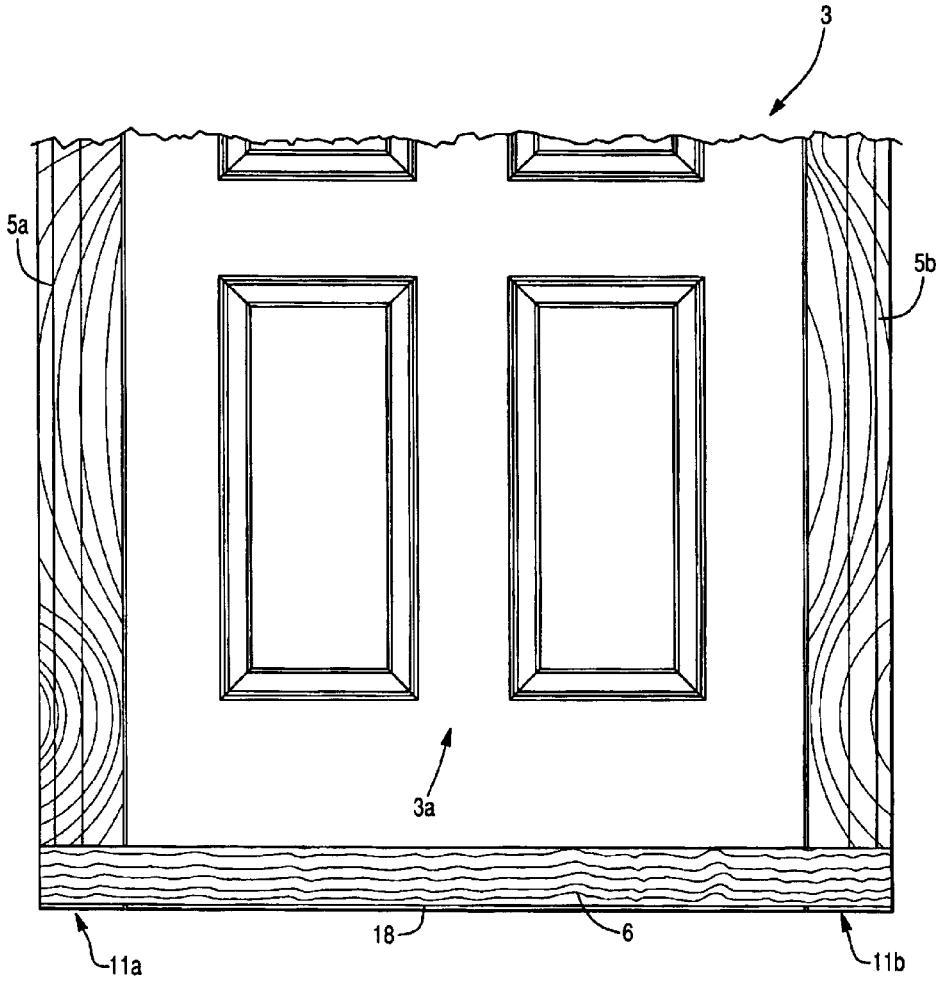
FIG. 9 is an isometric view showing a front view of the pre-hung door assembly with a skid plate blank on the bottom of the door assembly.

Referring to FIGS. 1 and 2, one possible embodiment of the present invention comprises a skid plate blank 1 adapted for attachment to the bottom surface 2 of a door assembly 3. Pre-hung door assemblies, whether comprising a hinged door or a sliding door arrangement, typically includes a pair of parallel doorjambs 4*a* and 4*b* extending between a header (not shown) and a threshold or sill plate assembly 6, exterior trim or molding 5*a* and 5*b* attached to respective doorjambs, and a door 3*a* (shown in FIG. 9). The threshold or sill plate assembly 6 generally includes an extruded aluminum sill plate 7 along the exterior side of the door and a wood sill plate 8 along the interior side of the door. As heretofore mentioned, depending upon the particular building design, the door assembly bottom surface 2 is often subjected to wet or damp conditions that cause wood rot along the bottom surface, and in particular, such wood rot generally begins at the crosscut bottom ends of the doorjambs 4*a* and 4*b* and at the crosscut bottom ends of the exterior trim members 5*a* and 5*b*. This is because the end grain at such crosscut ends is especially vulnerable to wood rot because the end grain wicks moisture and water up into the long grain of the wooden members. Additionally, such crosscut jamb and trim ends are easily damaged during shipping and handling.

The present invention overcomes such decay and damage problems by providing a skid plate 1 manufactured from a flexible water resistant material, for example a sheet of polyethylene or other impermeable material, that is bendable and capable of being bonded to the door assembly bottom surface 2. In the preferred embodiment, a sheet of high density polyethylene having a nominal thickness of 0.016 inches is used which material provides a satisfactory degree of wear resistance. Referring in particular to FIG. 1, skid plate 1 comprises a sheet of flexible water resistant material having a first side portion 9*a* spaced apart from a second side portion 9*b*, and an elongated center portion 9*c* positioned between the first and second side portions 9*a* and 9*b* respectively. The first side 9*a* and the second side 9*b* are shaped by cutting, slitting and/or stamping so that the side portions substantially correspond with the doorjamb and exterior trim crosscut periphery along the bottom of a selected door assembly 3. For example, the first side 9*a* includes a tab 10*a* and a jamb/trim portion 11*a*. Tab 10*a* is defined by a slit 12*a* and a score-line 13*a*. Slit 12*a* extends in a direction from a first side edge 14*a* toward the skid plate centerline X—X, and the cooperating score-line 13*a* extends from an interior threshold edge 15 to a position that intersects slit 12*a*. The length of slit 12*a* is predetermined so that when tab 10*a* is folded along score-line 13*a*, the folded tab is positioned to engage the framing side 16*a* of the doorjamb 4*a* (FIG. 2).

The jamb/trim portion 11*a* of skid plate 1 is positioned forward and inward with respect to tab 10*a*, adjacent slit 12*a* and score-line 13*a* respectively, and the jamb/trim portion is shaped to substantially correspond with the crosscut bottom ends of the jamb 4*a* and exterior trim 5*a* of the exemplary selected door assembly shown in FIG. 2. A first slit 17*a* extends inward from the exterior threshold edge 18 of the skid plate at a predetermined position that corresponds with the finish side edge 19*a* of doorjamb 4*a* in the exemplary door assembly shown in FIG. 2, slit 17*a* providing means for flexing or bending the elongated center portion 9*c* along its exterior threshold edge 18.

Similarly, the second side portion 9*b* includes a tab 10*b* and a jamb/trim portion 11*b*. Tab 10*b* is defined by a slit 12*b* and a score-line 13*b*. Slit 12*b* extends in a direction from a second side edge 14*b* toward the skid plate centerline X—X, and the cooperating score-line 13*b* extends from the interior threshold edge 15 to a position that intersects slit 12*b*. The length of slit 12*b* is predetermined so that when tab 10*b* is folded along score-line 13*b*, the folded tab is positioned to engage the framing side 16*b* of the doorjamb 4*b* (FIG. 2).

The jamb/trim portion 11*b* is positioned forward and inward with respect to tab 10*b*, adjacent slit 12*b* and score-line 13*b* respectively, and the jamb/trim portion is shaped to substantially correspond with the crosscut bottom ends of the jamb 4*b* and exterior trim 5*b* of the exemplary selected door assembly shown in FIG. 2. A second slit 17*b* extends inward from the exterior threshold edge 18 of the skid plate at a predetermined position that corresponds with the finish side edge 19*b* of doorjamb 4*b* in the exemplary door assembly shown in FIG. 2, slit 17*b* providing means for flexing or bending the elongated center portion 9*c* along its exterior threshold edge 18.

It should be understood that although the above detailed skid plate description is directed to a certain door assembly arrangement, the skid plate may be adapted to correspond with any bottom surface arrangement of a door assembly without departing from the scope of this invention.

Figure 3:
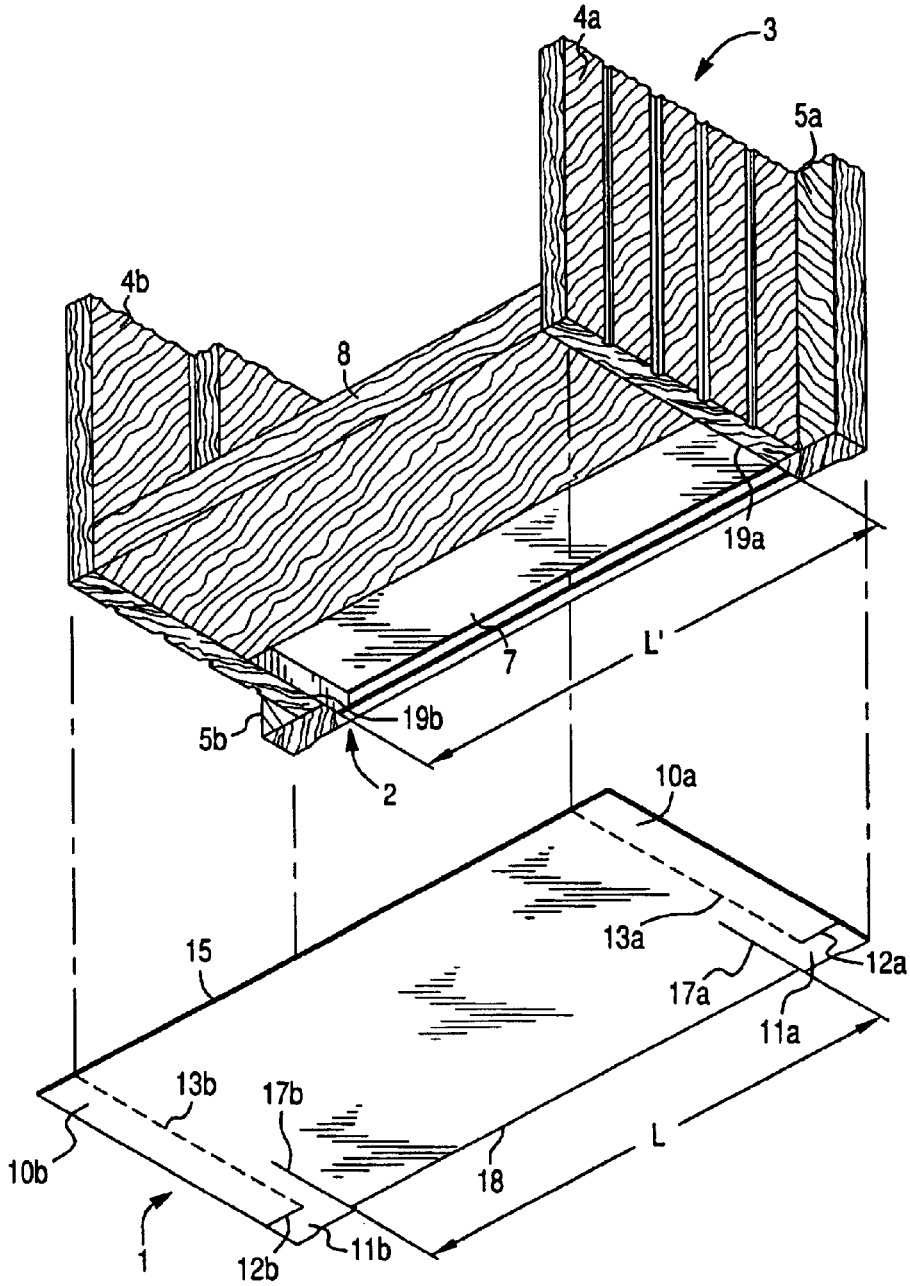
FIG. 3 is an isometric view showing the bottom of a door assembly with a skid plate blank positioned for installation.
Figure 4:
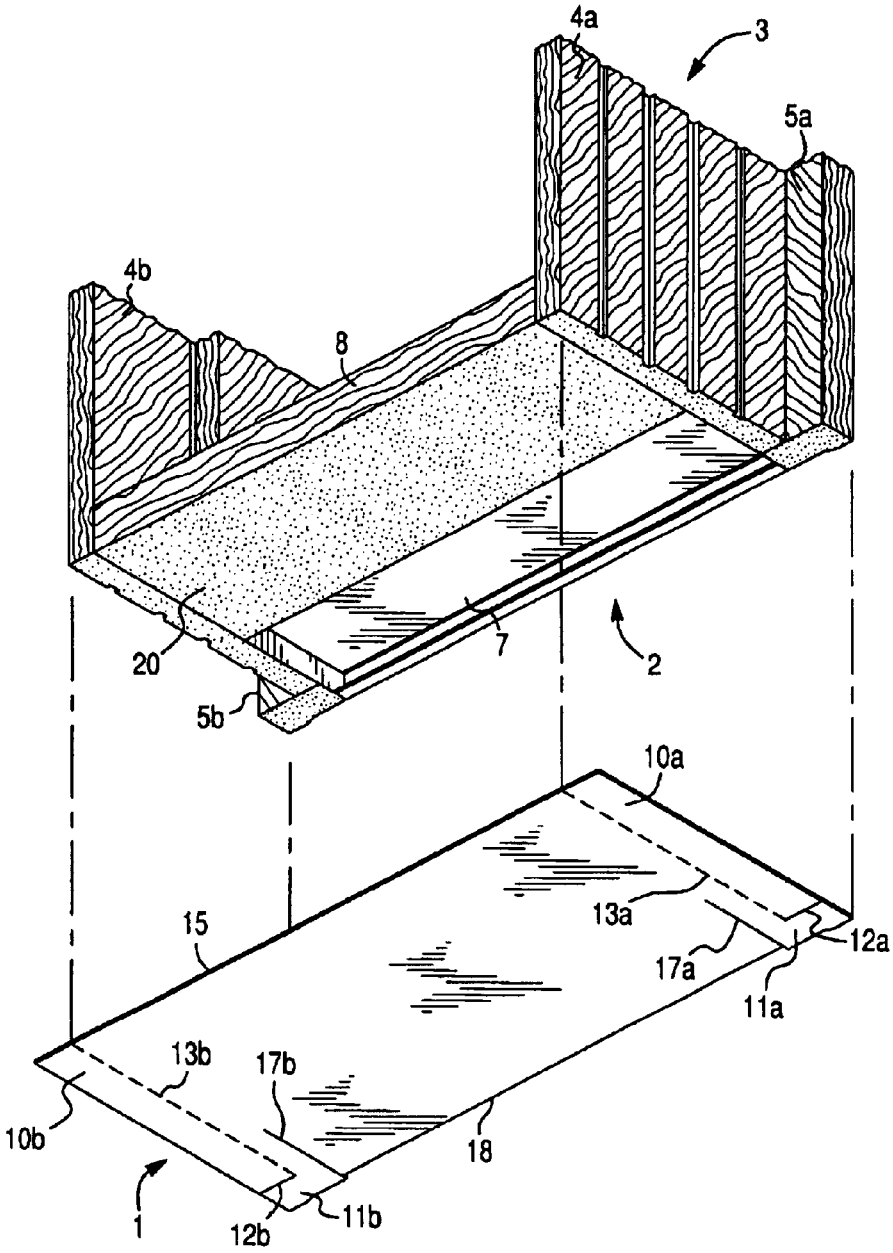
FIG. 4 is similar to FIG. 3 showing adhesive applied to the bottom of the door assembly.

Referring to FIG. 3, during the door assembly process, a skid plate 1 is provided having a length L, between the slits 17*a* and 17*b*, that corresponds with a length L', between the finish sides 19*a* and 19*b* of the assembled doorjambs 4*a* and 4*b* in the selected door assembly 3, so that when the skid plate is installed along the bottom surface 2 of the door assembly 3. This insures that the jamb/trim portions 11*a* and 11*b* are properly positioned to correspond with the crosscut bottom ends of their respective jamb and trim members 4*a*–4*b* and 5*a*–5*b* in the door assembly bottom. As shown in FIG. 4, an adhesive 20, suitable for bonding plastic material to a wood substrate, is applied to the crosscut doorjamb and trim bottom ends 4*a*–4*b* and 5*a*–5*b* respectively as well as along the bottom surface of the interior wood sill plate 8. The adhesive is applied by brushing, rolling, spraying, or dipping; or by any other suitable application means known in the art. The skid plate is placed on the adhesive coated bottom members and position so that the jamb/trim portions 11*a* and 11*b* of the skid plate 1 are aligned with the bottom crosscut ends of the jamb and trim members 4*a*–4*b* and 5*a*–5*b* respectively. It should be understood, however, that the adhesive may be applied to the skid plate 1 instead of to the door assembly bottom surfaces, or adhesive 20 may be applied to the door assembly bottom surfaces and to the skid plate 1 without departing from the scope of this invention.

Figure 8:
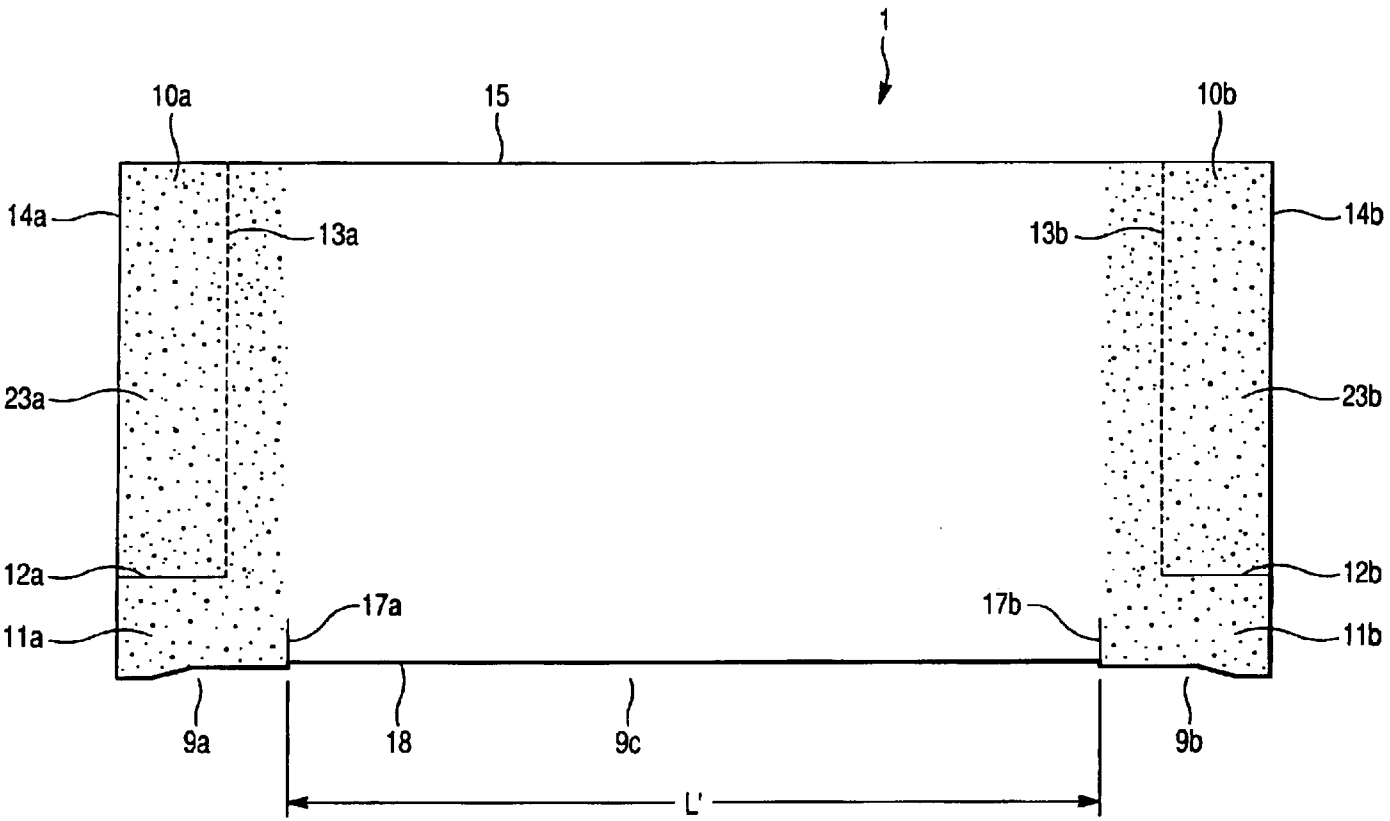
FIG. 8 is a plan view of a second embodiment of a skid plate blank provided with strips of double-sided adhesive tape for securing the skid plate to the door assembly.

As an alternative to the adhesive coating described above, the skid plate may be fastened to the bottom of the door assembly using two strips of double-sided adhesive tape 23*a* and 23*b* applied over first side 9*a* and second side 9*b* of the door assembly as shown in FIG. 8. The tape is preferably coated on both sides with a high performance permanent acrylic adhesive offering high tack and good shear such as FLEXmount laminating adhesive TT 200 L-606 or TT 400 L-606 available from FLEXcon Company, Inc. of Spencer, Mass. The preferred tape also has a 4 mil coat weight and an 84 pound poly-coated differential release liner. Tape 23*a* is applied over tab 10*a* and includes an edge aligned with slit 17*a*, and tape 23*b* is applied over tab 10*b* and includes an edge aligned with slit 17*b*. If the tapes are applied to the skid plate before slits 12*a* and 12*b* are formed in the skid plate, slits 12*a* and 12*b* will also extend through the tapes. Otherwise, slits aligned with slits 12*a* and 12*b* can be formed in the tapes after the tapes are applied. In use, the skid plate is pressed against the underside of the door assembly such that tape strips 23*a* and 23*b* adhere to a portion of the bottom of door sill 8, finish side edges 19*a* and 19*b*, and the bottoms of the finish/trim portions of the door assembly. Tab 19*a* and 19*b* are then folded over framing side 16*a* and 16*b* and adhered thereto to hold the skid plate securely in place.

Figure 5:
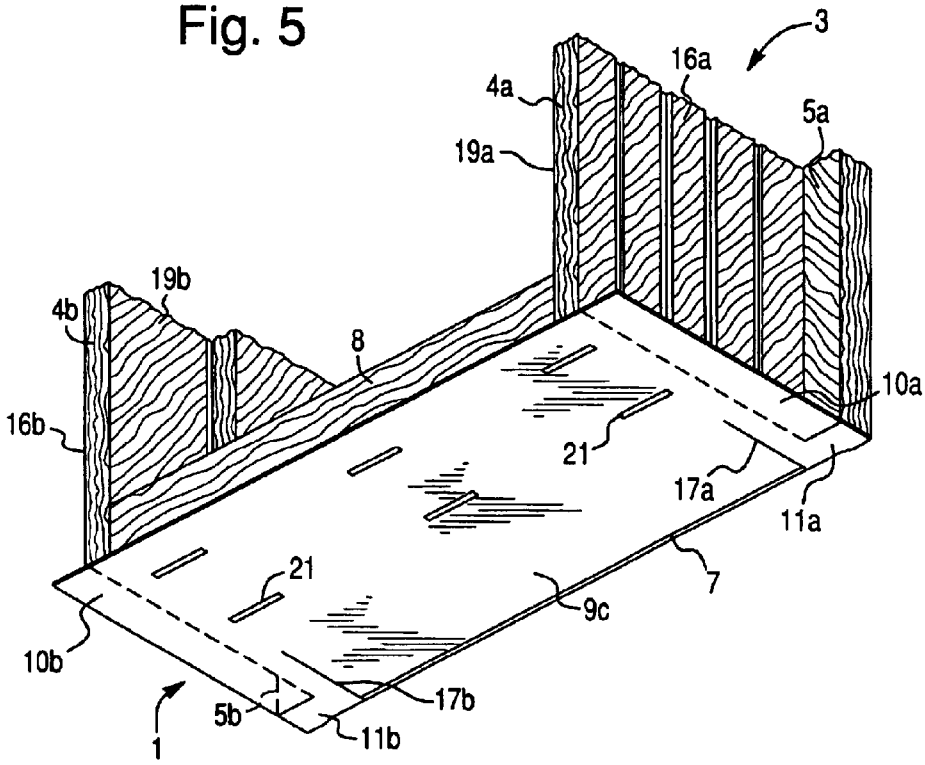
FIG. 5 is an isometric view showing a skid plate partially attached to the door assembly bottom.

As shown in FIG. 5, the positioned skid plate is fixed to the door assembly bottom surface 2 by driving fasteners 21 through the skid plate and into the long grain of the interior wooden sill plate 8. The drawing shows staples being used to attach the "glued" skid plate to the bottom surface 2. However, it should be understood that any suitable fastener such as nails, tacks, screws, etc. may be used.

Figure 6:
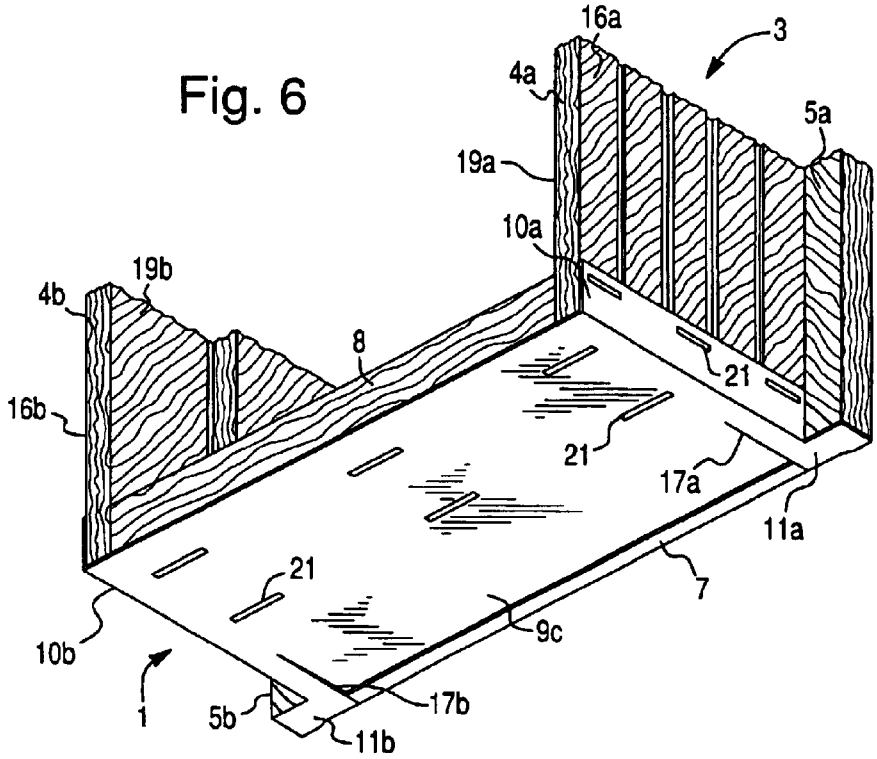
FIG. 6 is similar to FIG. 5 showing a skid plate fully attached to the door assembly bottom.

Referring to FIG. 6, after the skid plate is glued and mechanically fastened to the door assembly bottom surface 2, tabs 10*a* and 10*b* are folded along their respective score-lines 13*a* and 13*b* so that the tabs 10a and 10b contact the framing side surfaces 16*a* and 16*b* of the doorjambs. Adhesive may be applied to the respective doorjamb surfaces to bond the tabs 10*a* and 10*b* to the doorjambs, and tabs 10*a* and 10*b* are attached to the doorjambs by driving fasteners 21 through the tabs and into the long grain along the framing side of the jambs. The flexible center portion 9*c* extending between the slits 17*a* and 17*b* is tucked upward and into the aluminum sill plate 7 along the exterior side of the door, and the door assembly 3 is ready for shipping to a construction site after the adhesive cures and bonds the skid plate 1 to the door assembly bottom surface 2. The tab score-lines 13*a* and 13*b* facilitate folding the tabs 10*a* and 10*b* into engaging contact with the doorjambs. However, such scoring or notching along the tabs may be eliminated with the understanding that the tab folding operation may be considerably more difficult without score-lines.

Figure 7:
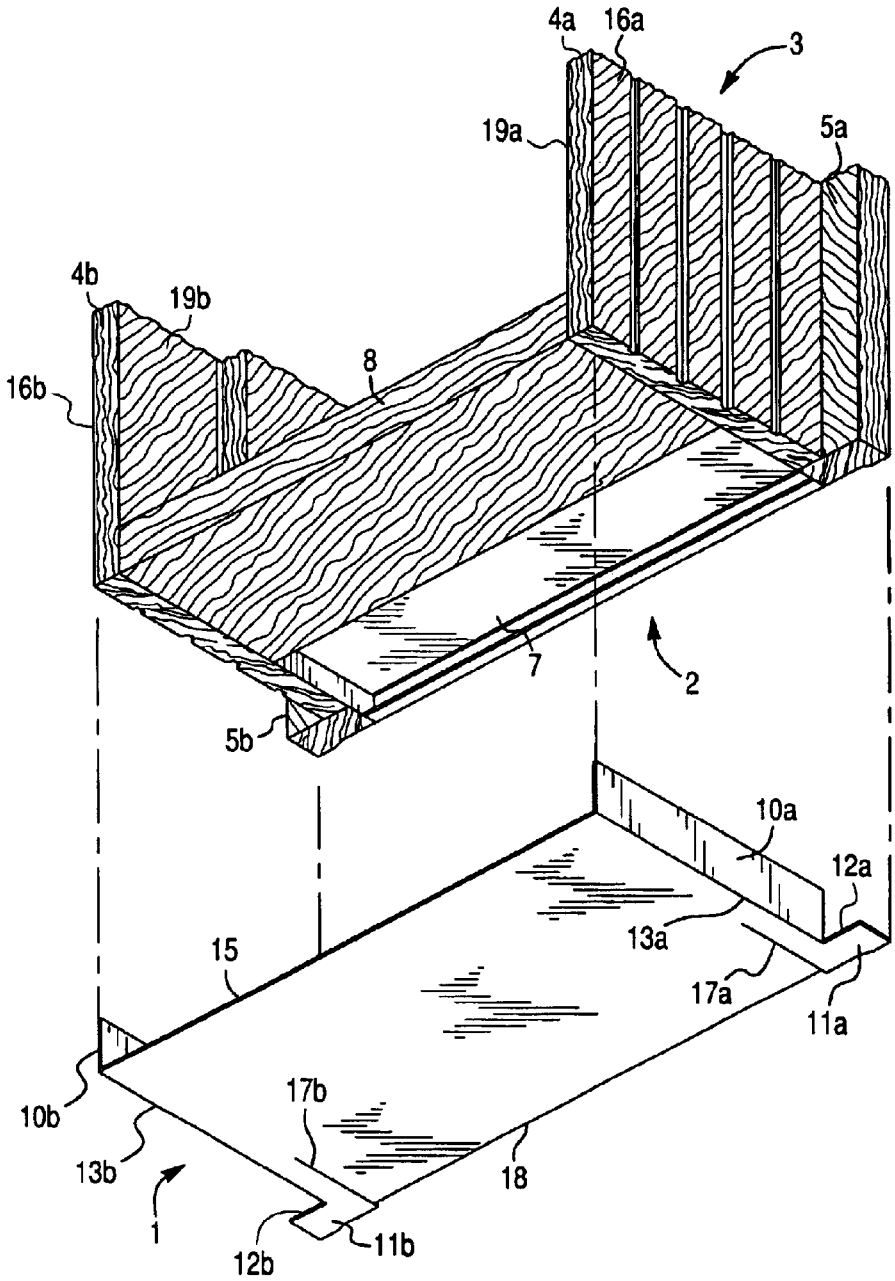
FIG. 7 is an isometric view showing an alternate method for attaching a skid plate to a door assembly bottom.

In an alternate embodiment shown in FIGS. 7, tabs 10*a* and 10*b* are folded to their upright engaged positions before skid plate 1 is placed on the adhesive coated bottom members along the bottom surface 2. Such pre-folding of the tabs 10*a* and 10*b* simplifies positioning the jamb/trim portions 11*a* and 11*b* of the skid plate into 20 alignment with the crosscut bottom ends of the jamb and trim members 4*a*–4*b* and 5*a*–5*b* of the exemplary selected door assembly 3.

It should also be understood that while this invention has been described according to the above various embodiments, it is capable of further modifications, uses, and/or adaptations of the invention, following the general principle of the invention and including such departures from the present disclosure that fall within known or customary practice in the art to which the invention pertains, and as may be applied to the central features hereinbefore set forth, and fall within the scope of the invention of the limits of the appended claims.

I claim:

1. A skid plate for attachment to a bottom portion of a door assembly, said skid plate comprising a generally rectangular sheet of material having:

a top edge;

a bottom edge;

first and second side edges extending between said top edge and said bottom edge;

a first tab defined by a first portion of said top edge, a first portion of said first side edge, a first fold line extending from said top edge parallel to said first side edge and a first cut extending from said first side edge to said first fold line, said first cut being spaced apart from said bottom edge by a first distance;

a second tab defined by a second portion of said top edge, a first portion of said second side edge, a second fold line extending from said top edge parallel to said second side edge and a second cut extending from said second side edge to said second fold line;

a first slit extending from said bottom edge parallel to said first side edge and having a length greater than said first distance; and, a second slit extending from said bottom edge parallel to said second side edge and having a length greater than said first distance.

2. The skid plate of claim 1 including a generally planar center portion between said first fold line and said second fold line wherein said first tab extends from said planar center section at an angle of approximately ninety degrees.

3. The skid plate of claim 1 wherein said sheet of material is flexible.

4. The skid plate of claim 3 wherein said sheet of material comprises polyethylene.

5. The skid plate of claim 4 wherein said polyethylene is high density polyethylene.

6. A pre-hung door assembly comprising:

a bottom defined by a portion of a door assembly disposed adjacent to a floor when said door assembly is stored in an upright operating position, a first side of said door assembly disposed normal to said bottom, and a second side of said door assembly disposed opposite said first side and normal to said bottom, said door assembly comprising:

a sill plate having an underside;

first and second door jambs connected to said sill plate;

first and second trim members having ends and connected to said first and second door jambs;

a skid plate comprising:

a planar portion overlying said underside of said sill plate and the ends of said first and second trim members;

first and second regions of said planar portion shaped to cover the ends of said first and second trim members; and a first tab normal to said planar portion, wherein said first and second regions are aligned with and overlay the ends of said first and second trim members when said planar portion overlays said sill plate and said tab overlays said first side.

7. The assembly of claim 6 wherein said skid plate is adhesively secured to said sill plate.

8. The assembly of claim 6 including fasteners extending through said first tab into said first side.

9. The assembly of claim 7 including fasteners extending through said first tab into said first side.

* * * * *